US012029359B2

(12) United States Patent
Doblosky

(10) Patent No.: US 12,029,359 B2
(45) Date of Patent: Jul. 9, 2024

(54) BACK WASHING ASSEMBLY

(71) Applicant: Natalka Doblosky, Hillsdale, NJ (US)

(72) Inventor: Natalka Doblosky, Hillsdale, NJ (US)

( * ) Notice: Subject to any disclaimer, the term of this patent is extended or adjusted under 35 U.S.C. 154(b) by 518 days.

(21) Appl. No.: 17/361,493

(22) Filed: Jun. 29, 2021

(65) Prior Publication Data

US 2022/0408983 A1 Dec. 29, 2022

(51) Int. Cl.
*A47K 7/02* (2006.01)
*A47K 7/03* (2006.01)

(52) U.S. Cl.
CPC ..... *A47K 7/022* (2013.01); *A47K 7/03* (2013.01)

(58) Field of Classification Search
CPC ..... A47K 10/12; A47K 7/03; A47K 7/022
USPC ..... 15/104.94
See application file for complete search history.

(56) References Cited

U.S. PATENT DOCUMENTS 3,860,349 A 1/1975 Scott
3,977,796 A 8/1976 Gillespie
5,545,456 A 8/1996 Suida
6,227,742 B1 5/2001 Corn
6,499,901 B1 12/2002 Rabbani
D901,944 S 11/2020 Mancini
2005/0186016 A1 8/2005 O'Brie
2006/0248672 A1* 11/2006 Dussaussoy ..... A45D 34/04 15/222
2015/0190017 A1* 7/2015 McBrayer ..... A47K 7/022 15/210.1
2016/0073835 A1 3/2016 Burrell
2022/0338683 A1* 10/2022 Brewer ..... A47K 7/08

FOREIGN PATENT DOCUMENTS

WO WO2015006665 1/2015

* cited by examiner

*Primary Examiner* — Tom Rodgers

(57) ABSTRACT

A back washing assembly includes a belt that is comprised of a fluid permeable material for washing a user's body. A plurality of pouches is each coupled to the belt to contain a piece of soap. Each of the pouches is comprised of a fluid permeable material release the soap on the user's body for bathing. A pair of handles is each of the handles is coupled to the belt for gripping. Each of the handles is positioned on opposite ends of the belt with respect to each other to facilitate the belt to be extended across the user's back for scrubbing the user's back. A hook is movably positioned on a respective one of the handles to engage a support for suspending the belt from the support for storage. The hook is attachable to the strap when the belt is rolled up for storing the belt.

4 Claims, 5 Drawing Sheets

BACK WASHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to washing devices and more particularly pertains to a new washing device for washing a user's back. The device includes a belt, a plurality of pouches that can each receive a piece of soap and a pair of handles each being coupled to the belt. Additionally, the device includes a hook and a loop that is integrated into the strap. The hook can engage the loop when the belt is rolled up for storing the belt.

(2) Description of Related Art Including Information Disclosed Under 37 CFR 1.97 and 1.98

The prior art relates to washing devices that each includes a belt that has a soap compartment integrated into the belt for washing a user's back. In each case a pair of handles is disposed on opposite ends of the belt for gripping. The prior art discloses a wash cloth assembly that has soap compartment integrated therein for receiving a piece of soap. In no instance does the prior art disclose a belt with soap compartments, a pair of handles for gripping, a hook coupled to the belt and a loop coupled to the belt for retaining the belt in a roll for storage.

BRIEF SUMMARY OF THE INVENTION

An embodiment of the disclosure meets the needs presented above by generally comprising a belt that is comprised of a fluid permeable material for washing a user's body. A plurality of pouches is each coupled to the belt to contain a piece of soap. Each of the pouches is comprised of a fluid permeable material release the soap on the user's body for bathing. A pair of handles is each of the handles is coupled to the belt for gripping. Each of the handles is positioned on opposite ends of the belt with respect to each other to facilitate the belt to be extended across the user's back for scrubbing the user's back. A hook is movably positioned on a respective one of the handles to engage a support for suspending the belt from the support for storage. The hook is attachable to the strap when the belt is rolled up for storing the belt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
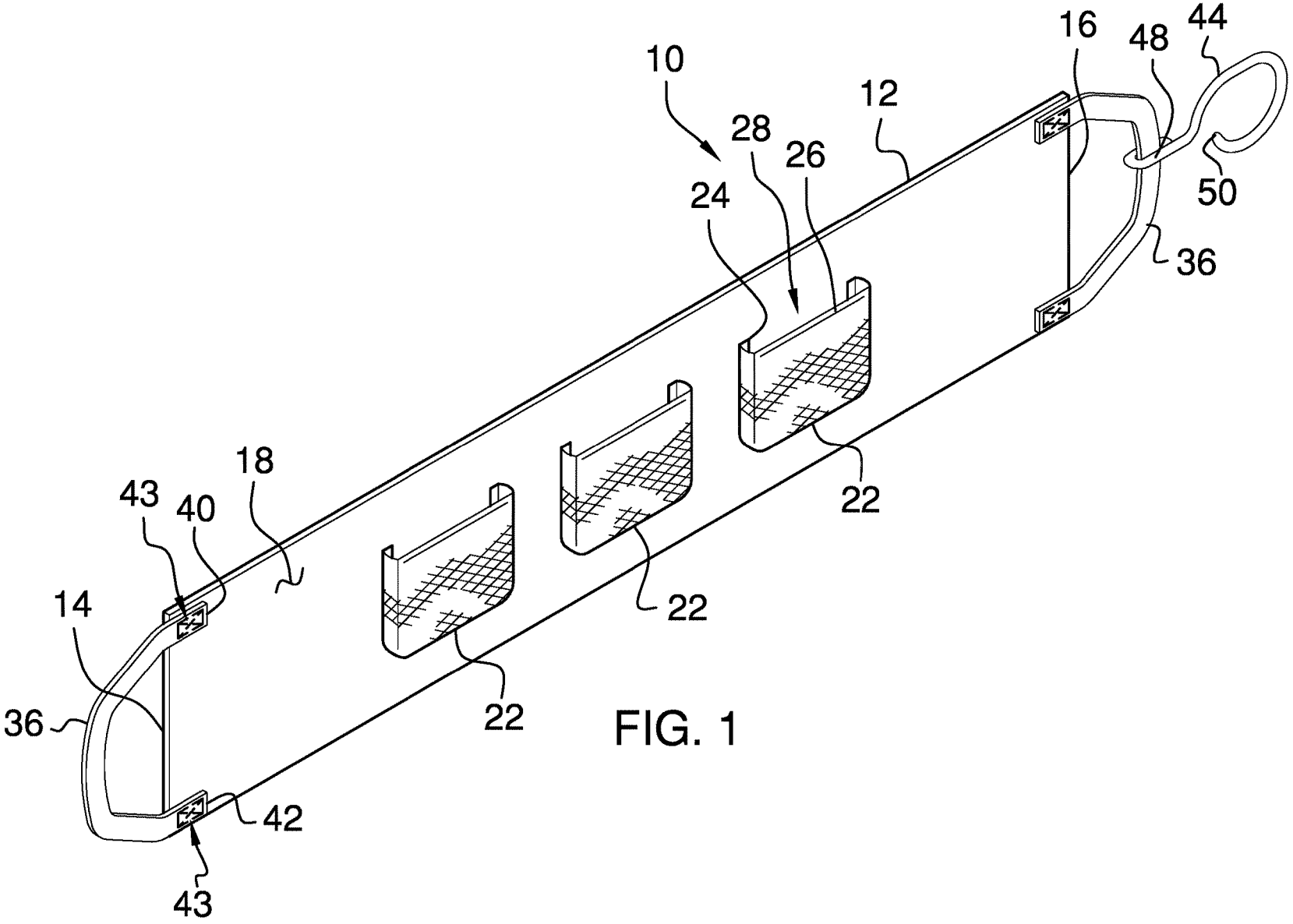
FIG. 1 is a front perspective view of a back washing assembly according to an embodiment of the disclosure.
Figure 2:
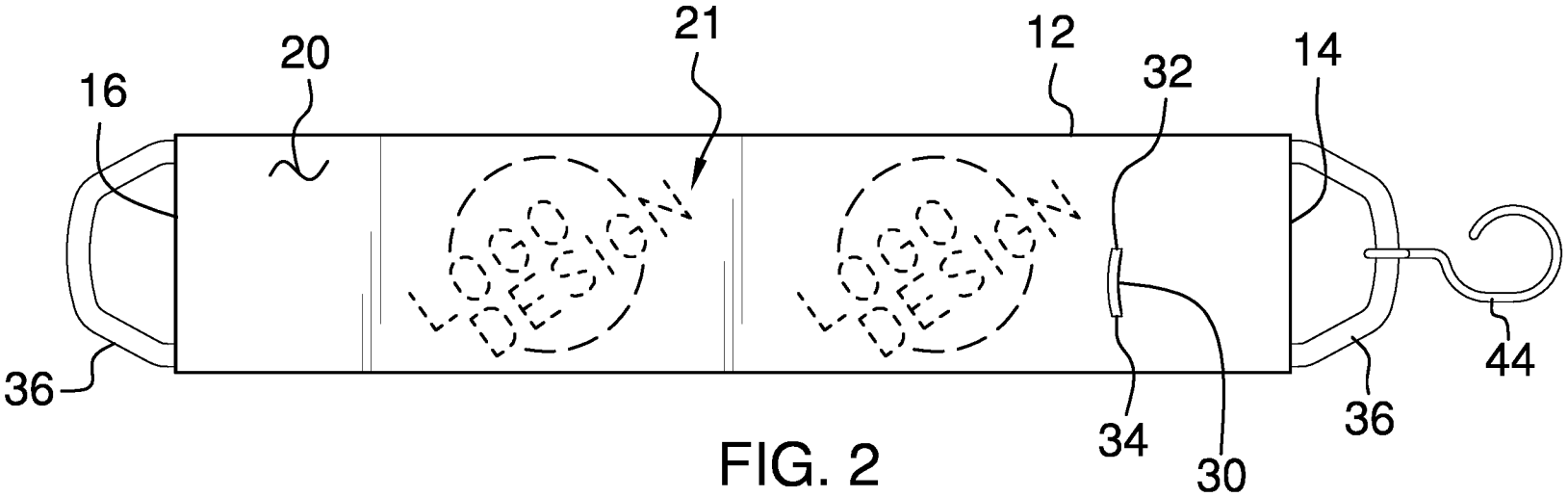
FIG. 2 is a back view of an embodiment of the disclosure.
Figure 3:
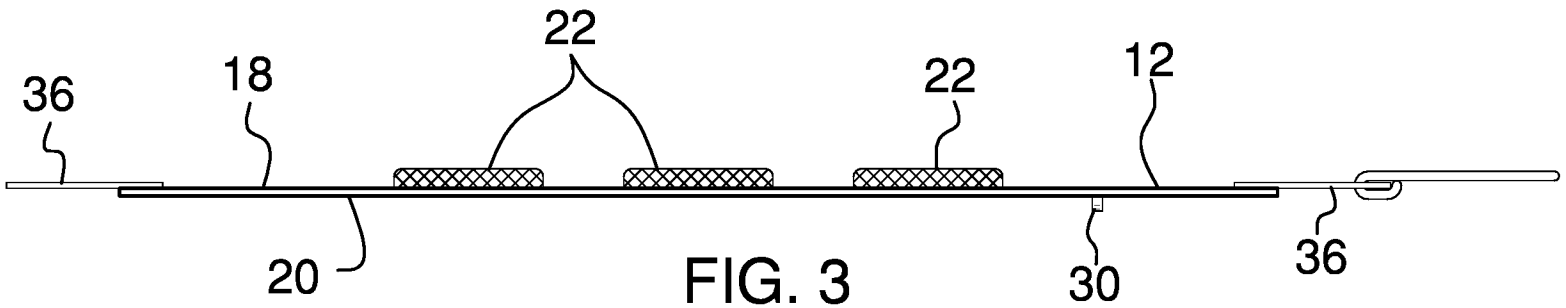
FIG. 3 is a top view of an embodiment of the disclosure.
Figure 4:
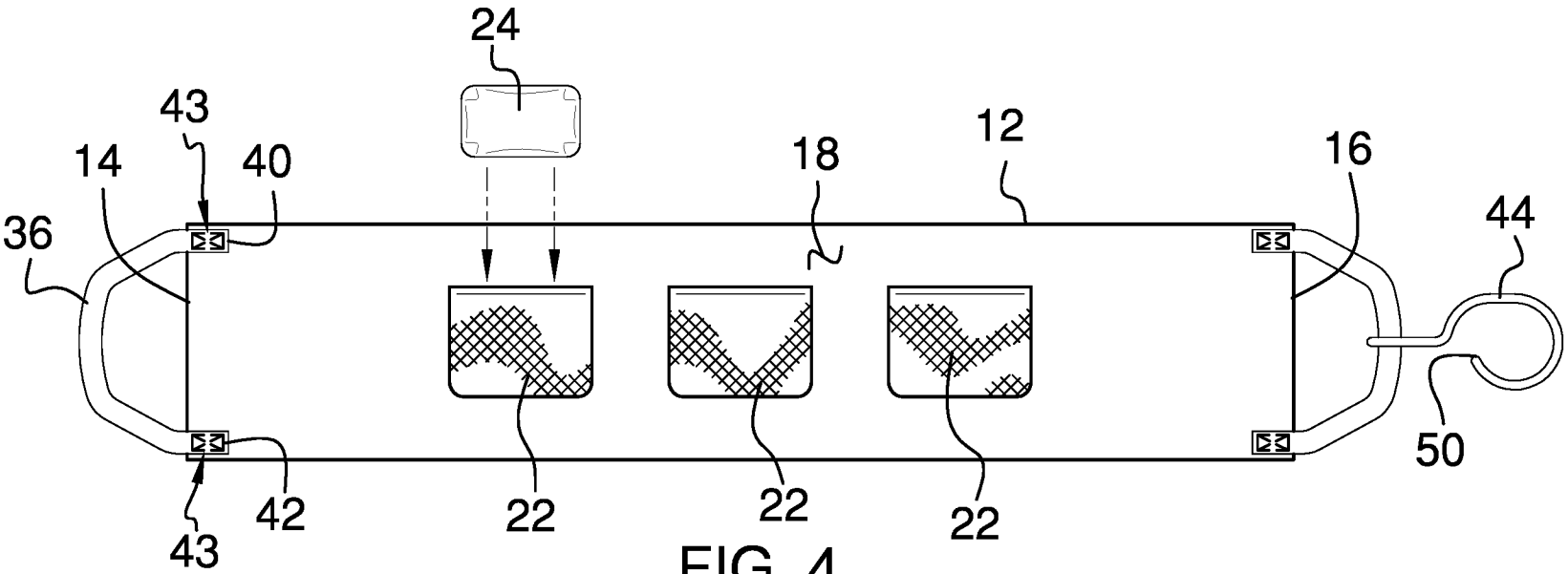
FIG. 4 is a front view of an embodiment of the disclosure.
Figure 5:
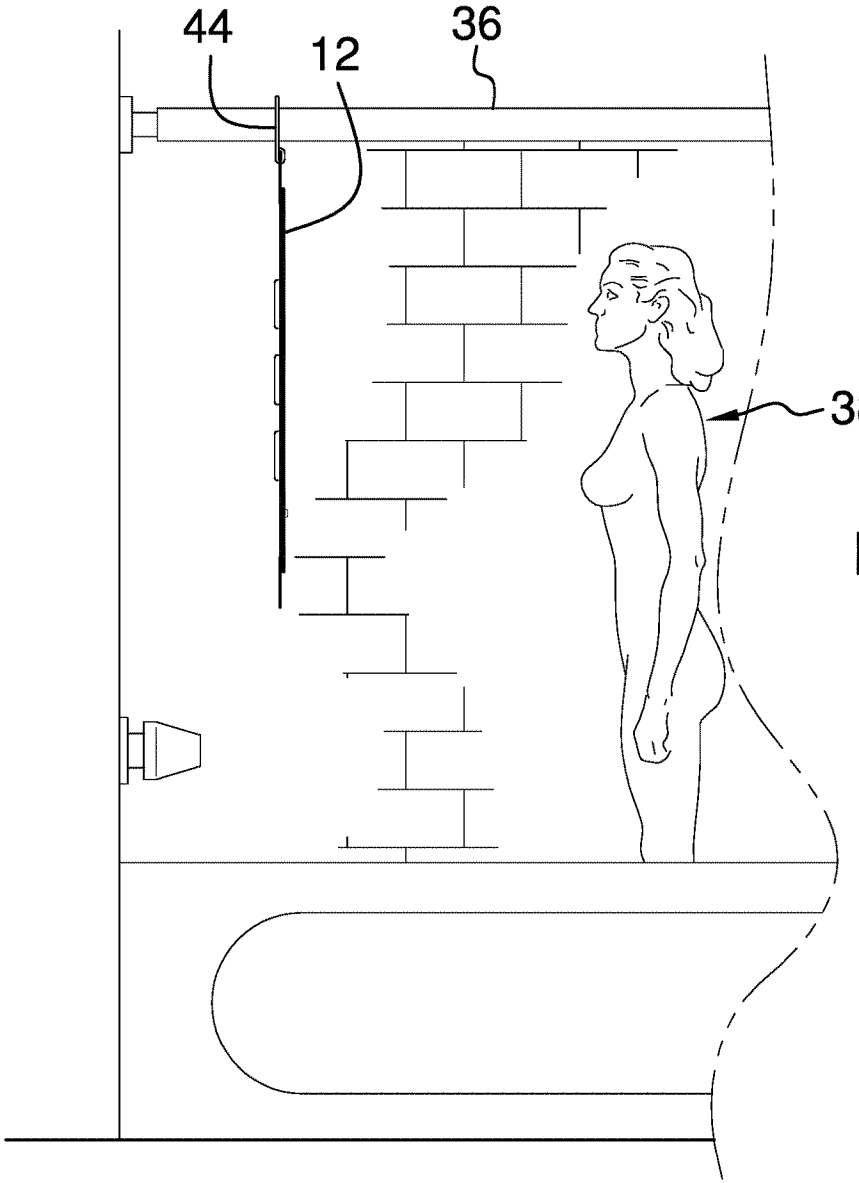
FIG. 5 is a perspective in-use view of an embodiment of the disclosure showing a belt being suspended from a support.
Figure 6:
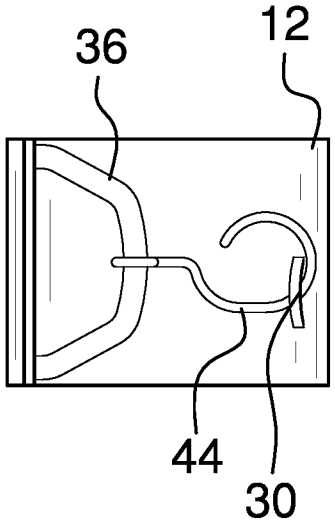
FIG. 6 is a perspective in-use view of an embodiment of the disclosure showing a belt being rolled up and a hook being engaged to a strap.

With reference now to the drawings, and in particular to FIGS. 1 through 6 thereof, a new washing device embodying the principles and concepts of an embodiment of the disclosure and generally designated by the reference numeral 10 will be described.

As best illustrated in FIGS. 1 through 6, the back washing assembly 10 generally comprises a belt 12 that is comprised of a fluid permeable material such that the belt 12 can be employed for washing a user's body in a shower or the like. The fluid permeable material may include, but not be limited to, terry cloth, microfiber, silicone of other type of similar material. Additionally, the belt 12 may be comprised of a mold resistant, bisphenol A free, food grade material. The belt 12 has a first end 14, a second end 16, a first surface 18 extending between the first end 14 and the second end 16, and a second surface 20 extending between the first end 14 and the second end 16. As is most clearly shown in FIG. 2, indicia 21 may be printed on the second surface 20 and the indicia 21 may comprise a logo, an image or any other chosen ornamental indicia.

A plurality of pouches 22 is provided, each of the pouches 22 is coupled to the belt 12 and each of the pouches 22 can contain a piece of soap 24. Each of the pouches 22 is comprised of a fluid permeable material to release the soap 24 on the user's body for bathing. Each of the pouches 22 has a perimeter edge 24 and the perimeter edge 24 of each of the pouches 22 has a top side 26. The perimeter edge 24 of each of the pouches 22 is coupled to the first surface 18 of the belt 12. Additionally, the top side 26 of the perimeter edge 24 of each of the pouches 22 is free from the first surface 18 to define an opening 28 into each of the pouches 22 for receiving the soap 24. The plurality of pouches 22 is spaced apart from each other on the first surface 18. The plurality of pouches 22 is evenly spaced from the first end 14 and the second end 16 such the plurality of pouches 22 is centrally positioned on the belt 12. Additionally, each of the pouches 22 is comprised of a mesh material.

A strap 30 is coupled to the belt 12 such that the strap 30 forms a closed loop. The strap 30 has a primary end 32 and a secondary end 34, and each of the primary end 32 and the secondary end 34 is coupled to the second surface 20 of the belt 12 such that the strap 30 forms an arch on the belt 12. Additionally, the strap 30 is positioned closer to the first end 14 than the second end 16. A pair of handles 36 is each coupled to the belt 12 such that each of the handles 36 can be gripped. Each of the handles 36 is positioned on opposite ends of the belt 12 with respect to each other to facilitate the belt 12 to be extended across the user's back 38 for scrubbing the user's back 38.

Each of the handles 36 has a first end 40 and a second end 42, and each the handles 36 is curved between the first end 40 and the second end 42 of the handles 36 such that each of the handles 36 has a U-shape. Each of the handles 36 is attached to the first surface 18 of the belt 12 at a pair of connection points 43 that is each located adjacent to a respective one of the first end 40 and the second end 42 of a respective handle. Additionally, each of the handles 36 extends outwardly beyond a respective first end 14 and second end 16 of the belt 12.

A hook 44 is movably positioned on a respective one of the handles 36 and the hook 44 can engage a support 46, such as a shower curtain rod for example, to suspend the belt 12 from the support 46 for storage. Furthermore, the hook 44 is attachable to the strap 30 when the belt 12 is rolled up for storing the belt 12. The hook 44 has a closed loop 48 that is integrated into the hook 44 and a distal end 50 with respect to the closed loop 48. The hook 44 is curved between the closed loop 48 and the distal end 50 such that the distal end 50 is directed toward the closed loop 48. Moreover, the respective handle 36 extends through the closed loop 48.

In use, the pieces of soap 24, which might be the remains of bars of soap that are not longer large enough to use, are each positioned into the pouches 22. In this way the pieces of soap 24 can be completely used for bathing. Each of the handles 36 is gripped to facilitate the user to scrub their back 38 with the belt 12 having the pouches 22 being pressed against their back 38. In this way the user can wash their back 38 without assistance. Additionally, liquid soap, body wash or any other type of soap that can used for bathing can be positioned in the pouches 22. The belt 12 can be rolled up, end to end, and the hook 44 can be engaged to the strap 30 for storing the belt 12. Furthermore, the hook 44 can be suspended from the support for drying the belt 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A back washing assembly for facilitating a user to wash their back without assistance, said assembly comprising:

a belt being comprised of a fluid permeable material wherein said belt is configured to be employed for washing a user's body;

a plurality of pouches, each of said pouches being coupled to said belt wherein each of said pouches is configured to contain a piece of soap, each of said pouches being comprised of a fluid permeable material wherein each of said pouches is configured to release the soap on the user's body for bathing;

a strap being coupled to said belt such that said strap forms a closed loop;

a pair of handles, each of said handles being coupled to said belt wherein each of said handles is configured to be gripped, each of said handles being positioned on opposite ends of said belt with respect, to each other wherein each of said handles is configured to facilitate said belt to be extended across the user's back for scrubbing the user's back;

a hook being movably positioned on a respective one of said handles wherein said hook is configured to engage a support for suspending said belt from the support for storage, said hook being attachable to said strap when said belt is rolled up for storing said belt; and wherein said hook has a closed loop being integrated into said hook and a distal end with respect to said closed loop of said hook, said hook being curved between said closed loop and said distal end such that said distal end is directed toward said closed loop of said strap, said respective handle extending through said closed loop of said hook.

2. The assembly according to claim 1, wherein:

said belt has a first end, a second end, a first surface extending between said first end and said second end and a second surface extending between said first end and said second end;

each of said pouches has a perimeter edge, said perimeter edge of each of said pouches having a top side, said perimeter edge of each of said pouches being coupled to said first surface of said belt, said top side of said perimeter edge of each of said pouches being free from said first, surface to define an opening into each of said pouches for receiving the soap, said plurality of pouches being spaced apart from each other on said first surface, said plurality of pouches being evenly spaced from said first end and said second end, each of said pouches being comprised of a mesh material; and said strap has a primary end and a secondary end, each of said primary end and said secondary end being coupled to said second surface of said belt such that said strap forms an arch on said belt, said strap being positioned closer to said first, end than said second end.

3. The assembly according to claim 2, wherein each of said handles has a first end and a second end, each said handles being curved between said first end and said second end of said handles such that each of said handles has a U-shape, each of said handles being attached to said first surface of said belt at a pair of connection points each being located adjacent to a respective one of said first end and said second end of a respective handle, each of said handles extending outwardly beyond a respective first end and second end of said belt.

4. A back washing assembly for facilitating a user to wash heir back without assistance, said assembly comprising:

a belt being comprised of a fluid permeable material wherein said belt is configured to be employed for washing a user's body, said belt having a first end, a second end, a first surface extending between said first end and said second end and a second surface extending between said first end and said second end;

a plurality of pouches, each of said pouches being coupled to said belt wherein each of said pouches is configured to contain a piece of soap, each of said pouches being comprised of a fluid permeable material wherein each of said pouches is configured to release the soap on the user's body for bathing, each of said pouches having a perimeter edge, said perimeter edge of each of said pouches having a top side, said perimeter edge of each of said pouches being coupled to said first surface of said belt, said top side of said perimeter edge of each of said pouches being free from said first surface to define an opening into each of said pouches for receiving the soap, said plurality of pouches being spaced apart from each other on said first surface, said plurality of pouches being evenly spaced from said first end and said second end, each of said pouches being comprised of a mesh material;

a strap being coupled to said belt such that said strap forms a closed loop, said strap having a primary end and a secondary end, each of said primary end and said secondary end being coupled to said second surface of said belt such that said strap forms an arch on said belt, said strap being positioned closer to said first end than said second end;

a pair of handles, each of said handles being coupled to said belt wherein each of said handles is configured to be gripped, each of said handles being positioned on opposite ends of said belt with respect to each other wherein each of said handles is configured to facilitate said belt to be extended across the user's back for scrubbing the user's back, each of said handles having a first end and a second end, each said handles being curved between said first end and said second end of said handles such that each of said handles has a U-shape, each of said handles being attached to said first surface of said belt at a pair of connection points each being located adjacent to a respective one of said first end and said second end of a respective handle, each of said handles extending outwardly beyond a respective first end and second end of said belt; and a hook being movably positioned on a respective one of said handles wherein said hook is configured to engage a support for suspending said belt from the support for storage, said hook being attachable to said strap when said belt is rolled up for storing said belt, said hook having a closed loop being integrated into said hook and a distal end with respect to said closed loop of said hook, said hook being curved between said closed loop and said distal end such that said distal end is directed toward said closed loop of said strap, said respective handle extending through said closed loop of said hook.

* * * * *